US005580296A

United States Patent [19]

Chow

[11] Patent Number: 5,580,296

[45] Date of Patent: Dec. 3, 1996

[54] TOY VEHICLE WITH CHANGEABLE APPEARANCE AS FUNCTION OF DIRECTION OF MOVEMENT

[75] Inventor: Wai H. Chow, Hong Kong, Hong Kong

[73] Assignee: Echo Toys Ltd., Hong Kong

[21] Appl. No.: 501,242

[22] Filed: Jul. 12, 1995

[51] Int. Cl.[6] ..... A63H 30/00

[52] U.S. Cl. ..... 446/443; 446/456; 446/462; 446/470; 446/487

[58] Field of Search ..... 446/272, 280, 446/288, 292, 448, 456, 457, 443, 462, 470, 487

[56] References Cited

U.S. PATENT DOCUMENTS

| | | | |
|---|---|---|---|
| 757,834 | 4/1904 | Patten . | |
| 2,961,797 | 11/1960 | Bonanno | 446/442 |
| 4,307,533 | 12/1981 | Sims | 446/365 |
| 4,508,516 | 4/1985 | D'Andrade | 446/454 |
| 4,568,307 | 2/1986 | Gabler | 446/448 |
| 4,772,242 | 9/1988 | McKay | 446/448 |
| 5,267,888 | 12/1993 | Hippely | 446/465 |
| 5,310,379 | 5/1994 | Hippely | 446/376 |
| 5,334,078 | 8/1994 | Hippely | 446/470 |

*Primary Examiner*—Robert A. Hafer
*Assistant Examiner*—Jeffrey D. Carlson
*Attorney, Agent, or Firm*—Kirschstein et al.

[57] ABSTRACT

A toy vehicle includes a vehicle body and front and rear wheels that are mounted on respective front and rear regions of the vehicle body for rotation about their axes. The toy vehicle further includes a pair of wings that is mounted on the vehicle body for movement between their extended, spread apart positions and their retracted positions. An upper jaw is mounted on the front region of the vehicle body for pivoting between a raised and a lowered position. A reversible electric motor and a gear transmission interposed between the motor and the rear wheels are accommodated in a common housing. The housing is mounted on the vehicle body for tilting movement about the axis of the rear wheels. A kinematic linkage translates the tilting movement of the housing that occurs in automatic response to energization of the motor in the appropriate sense into the movement of the wings and the pivoting of the upper jaw.

12 Claims, 3 Drawing Sheets

TOY VEHICLE WITH CHANGEABLE APPEARANCE AS FUNCTION OF DIRECTION OF MOVEMENT

BACKGROUND OF THE INVENTION

1. Field of the Invention

The present invention relates to toys in general, and more particularly to a toy vehicle capable of changing its appearance as a function of its direction of movement.

2. Description of the Related Art

There are already known various construction of toys, among them such that are provided with wheels and resemble cars, trucks or other land vehicles in appearance. Toys like that are very popular, but toys that are basically toy vehicles, but pretend that they are not, are even more appealing to a segment of the population interested in purchasing toys, be it children of tender years or their parents.

To satisfy the desire for toy vehicles of this kind, it has been proposed, for instance, in the U.S. Pat. Nos. 5,267,888 to Hippely, et al., 5,292,275 to Swisher, et al., and 5,334,078 to Hippely, et al., to give the toys the outward appearance of toy vehicles, but to provide them with menacing teeth that are revealed when a part of the toy vehicle that substitutes for a mouth is raised or lowered.

All of these previously proposed arrangements have one undesirable thing in common, though; namely, the revelation of the teeth and/or other actions, such as the issuance of growling noises, evidently result from an overt act, namely, from a manual lifting of the toy vehicle, or manipulation of a lever. While there may be some element of surprise, and the overt act is usually performed at a location that is remote from that at which the desired effect is to take place, the causal connection between the overt act and the menacing effect can be overlooked by only the most gullible of the audience and, hence, the very purpose of making this "covert menace" transformable toy vehicle in the manner as designed is, all but, defeated.

OBJECTS OF THE INVENTION

Accordingly, it is a general object of the present invention to avoid the disadvantages of the prior art.

More particularly, it is an object of the present invention to provide a transformable toy vehicle that does not possess the drawbacks of the known toy vehicles of this type.

Still another object of the present invention is to devise a toy vehicle of the type here under consideration which presents itself at its menacing best when heading for an uninitiated observer to scare him or her.

It is yet another object of the present invention to design the above toy vehicle in such a manner that the transformation from a rather demure to exceedingly menacing appearance occurs all of a sudden, seemingly without human intervention, and as an apparently volitional act on the part of the toy vehicle that has features reminiscent of an animal, such as a bat.

An additional object of the present invention is to change the shape and overall appearance of the toy vehicle as a function of a change in its direction of movement.

A concomitant object of the present invention is so to construct the toy vehicle of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a toy vehicle that includes a vehicle body having a front region and a rear region. Front and rear wheels are mounted on the front and rear regions of the vehicle body, respectively, for rotation about respective axes. The vehicle body has movable parts which, when moved, change the overall appearance and shape of the vehicle. Such movement is caused by a change in its direction of movement.

In a preferred embodiment, the movable parts include two wings mounted on the vehicle body for movement between their extended, spread apart positions and their retracted positions. An upper jaw is mounted on the front region of the vehicle body for pivoting between its raised and lowered positions.

There is further provided means for driving the toy vehicle, including a reversible electric motor, and a gear transmission interposed between the motor and the rear wheels. According to the present invention, the driving means is accommodated in a housing that is mounted on the vehicle body for tilting movement about the axis of the rear wheels. Then, the toy vehicle further includes means for translating the tilting movement of the housing that occurs in automatic response to energization of the motor in the appropriate sense into the movement of the wings and the pivoting of the upper jaw.

A particular advantage of the toy vehicle as described so far is that the above actions, that is the spreading of the wings and the raising of the upper jaw occur in automatic response to the energization of the motor in a sense to reverse the direction of movement of the toy vehicle, that is without visible human intervention. This significantly contributes to the illusion that the toy vehicle is actually a living creature, and a quite menacing one at that, and thus to the pleasure derived by the user from operating the toy.

In this connection, it is particularly advantageous when the translating means is operative for raising the upper jaw and spreading the wings preliminarily to movement of the toy vehicle in the forward direction, and vice versa prior to rearward movement of the toy vehicle.

This assures that the toy vehicle will be at its threatening best when seemingly flying toward an observer who is usually an uninitiated friend or schoolmate of the child operating the toy vehicle, with the seemingly deliberate spontaneous spreading of the wings and revelation of the teeth contributing to the illusion. This is, moreover, in stark contrast to the subdued appearance the toy vehicle assumes when moving in the backward direction, thus heightening the element of surprise.

According to a particularly advantageous facet of the present invention, the translating means includes a slider accommodated within the vehicle body for translatory movement relative thereto in the frontward and rearward directions, and means for connecting the slider with the tiltable housing and with the pivotable upper jaw with sufficient leeway to avoid jamming of the translating means. This feature is particularly useful because the various components of the translating means are able to conduct movements resulting in trajectories at the regions at which they are articulated to one another which are to an extent inconsistent with one another.

The connection between the pivotable upper jaw and the slider that conducts a translatory motion is a typical example of the discrepancy between the paths that could result in jamming. More particularly, the connection point on the slider can only move along a plane, and the corresponding point connected to the upper jaw only along a cylinder. The aforementioned connecting means thus serves a useful purpose in that it permits the associated points of the slider and of the upper jaw to move in their predestined trajectories without trying to force the other point to follow suit in a direction incompatible with the movement of such other point.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
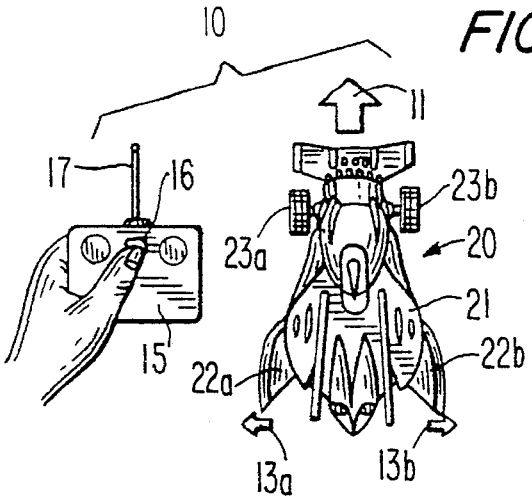
FIG. 1 is a top plan view, at a reduced scale, of a toy vehicle of the present invention as configured during forward movement, together with a control unit.
Figure 2:
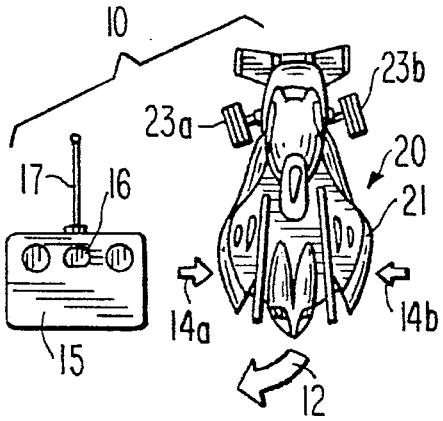
FIG. 2 is a view similar to FIG. 1 but showing the toy vehicle as configured during backward movement.

Referring now to the drawing in detail, and first to FIGS. 1 and 2 thereof, it may be seen that the reference numeral 10 has been used therein to identify a toy vehicle set of the present invention in its entirety. The toy vehicle set 10 includes as its main or operative component a toy vehicle 20 that is driven, in a manner to be discussed later, to move either in a forward direction as indicated by an arrow 11 in FIG. 1, or in a backward direction as indicated in FIG. 2 by an arrow 12.

The toy vehicle 20 includes a body 21 on which there are mounted two wings 22*a* and 22*b*. Each of the wings 22*a* and 22*b* is supported on the vehicle body 21 for movement between its extended and retracted positions with respect to the body 21. As also indicated in FIG. 1 of the drawing by arrows 13*a* and 13*b*, the wings 22*a* and 22*b* are moved outwardly or extended when the toy vehicle 20 moves in the forward direction of the arrow 11, whereas they are displaced inwardly or retracted when the toy vehicle 10 drives in reverse as indicated by the arrow 12. This is indicated in FIG. 2 of the drawing by arrows 14*a* and 14*b*.

The movement of the toy vehicle 20, including the reversal of the driving direction, is caused by a reversible drive train, the details of which will be discussed later. The operation of the reversible drive train is remotely controlled by a hand-held controller or control unit 15 in response to control actions exerted on the latter by the user of the toy vehicle set 10.

As illustrated, the control unit 15 is equipped with a depressable button 16 that controls a switch that is incorporated in an electric circuitry of a radio transmitter. The switch and the circuitry are of well-known constructions that need not be and are not illustrated, nor will they be described here. Suffice it to say that the depression of the button 16 causes the transmitter to issue a signal commanding forward movement of the vehicle 20, whereas the release of the button 16 causes the transmitter to issue a different signal commanding the vehicle 20 to move in the backward direction.

It is to be mentioned at this juncture, though, that the transmission of "silence", i.e. of only a carrier without any modulation, or even discontinuance of the carrier itself, is tantamount to issuance of a signal, i.e. one or the other of the aforementioned signals, especially the last-mentioned one, may be constituted by such radio silence.

The transmitted signal is emitted at radio frequency by an antenna 17 provided on the control unit 15, and captured by a reception antenna 18 carried by the vehicle 20. The free ends of both antennas 17 and 18 are blunted so as not to present a menace to a user, usually a child. The respective radio signals that are captured by the antenna 18 are processed by electronic circuitry of well-known design that is accommodated at a convenient location within the vehicle body 21, and are converted to at least two command signals, one calling for the forward movement, and the other for the backward movement of the vehicle 20. These signals, in turn, are used, again in a manner that is well known, to control an electric motor forming a part of the aforementioned drive train so as to operate either in the forward, or in the reverse, mode. These is nothing new in principle about using reversible drive trains controlled by radio-frequency links in toys, especially in toy vehicles, so that no further elaboration on these basic tenets is deemed to be necessary.

In FIG. 2 of the drawing, the curved shape of the arrow 12 indicates that the toy vehicle 20 follows an arcuate path during its backward movement, as distinguished from the substantially straight movement of the toy vehicle 20 in the forward direction. This expedient, which is not that uncommon in radio-controlled toy vehicles, renders it possible, in a relatively simple way, to change the direction of forward movement of the vehicle 20, especially after the latter had encountered an obstruction, by temporarily backing it up to an extent sufficient for the vehicle 20 to aim in the desired new direction, followed by switching back to the forward driving mode.

This, of course, is preferable to requiring the user to bend down or otherwise change the vehicle position every time such directional change is desired or required; yet, the solution used here, namely the mounting of front wheels 23*a* and 23*b* on the body 21 for automatically turning in unison about substantially vertical axes between their end positions shown in FIGS. 1 and 2, respectively, in response to vehicle movement direction reversals, is much less expensive than providing for a full steerability of the vehicle 20, that is, full radio control of the positions of the wheels 23*a* and 23*b*. In addition to the front wheels 23*a* and 23*b*, there is provided, as usual, a pair of rear wheels 24*a* and 24*b*.

Figure 3:
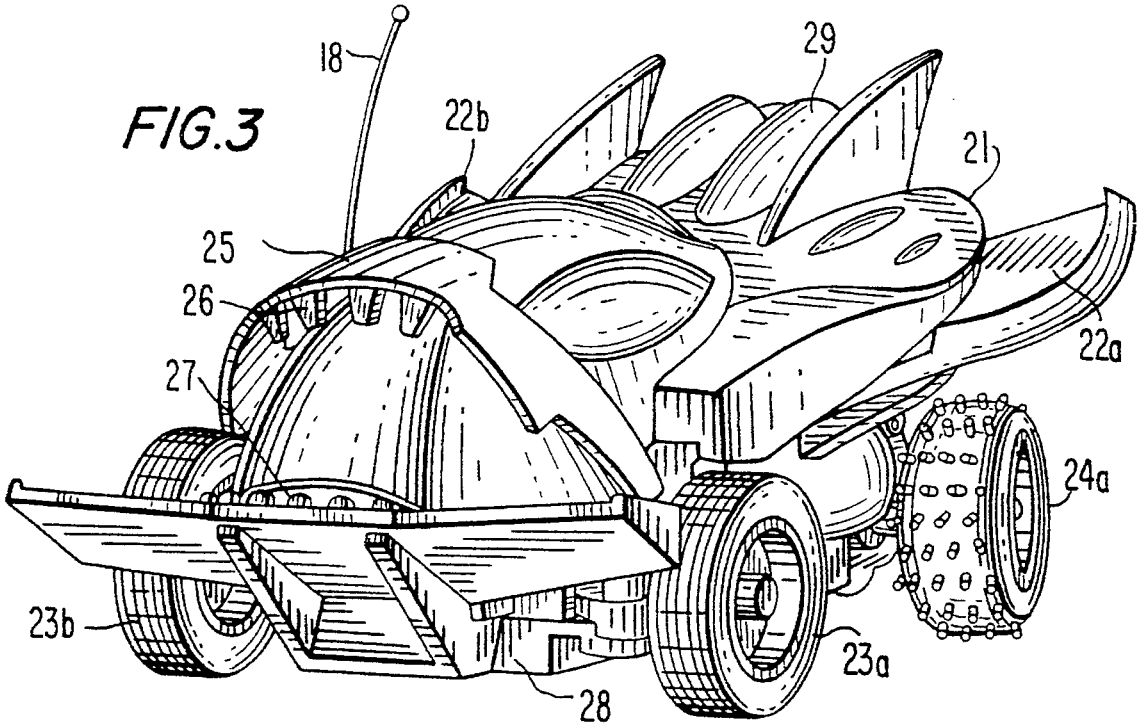
FIG. 3 is a front perspective view of the toy vehicle in the configuration of FIG. 1, at an enlarged scale.

It is also shown in FIG. 3 that there is provided an upper jaw member 25 that is mounted on the vehicle body 21 for pivoting relative thereto about a substantially horizontal axis extending transversely of the vehicle. The upper jaw member 25 is provided on its lower portion with a set of teeth 26, and an associated lower set of teeth 27 is provided on a corresponding region of the body 21, in general alignment or "overbite" relation with respect to the teeth 26. It is evident that the teeth are clearly visible when the upper jaw 25 is in its upwardly pivoted position depicted in FIG. 3, thus giving the vehicle 20 a desired menacing appearance. Inasmuch as this position is assumed, as will be explained in more detail later, when the vehicle 20 moves forward, that is toward an observer, the desirable frightening effect is assured.

The front wheels 23*a* and 23*b*, as well as rear wheels 24*a* and 24*b*, are mounted on a lower body part or chassis 28 for rotation about respective axes. As will be explained later, the rear wheels 24*a* and 24*b* are driven, that is they are caused to rotate in what will be referred to herein as the forward or reverse sense, to impart forward or backward movement on the body 21, respectively.

The aforementioned upper jaw 25 is preferably mounted for its aforementioned pivoting movement on the chassis 28 which thus constitutes a relatively solid or stable platform or support on which the various movable parts are mounted for movement with respect thereto. Besides the lower body portion or chassis 28, the vehicle body 21 includes an upper body portion 29 that is removably secured to the lower body portion 28. The upper body portion 29 has an appearance that contributes to the aforementioned frightening effect; it is currently preferred for the upper body portion 29 to have a configuration and/or features reminiscent of a bat. This, combined with the extendable wings 22*a* and 22*b*, gives an observer situated in the path of forward movement of the vehicle 20, especially a small child, quite a realistic impression that a rabid bat is flying toward him or her.

Figure 4:
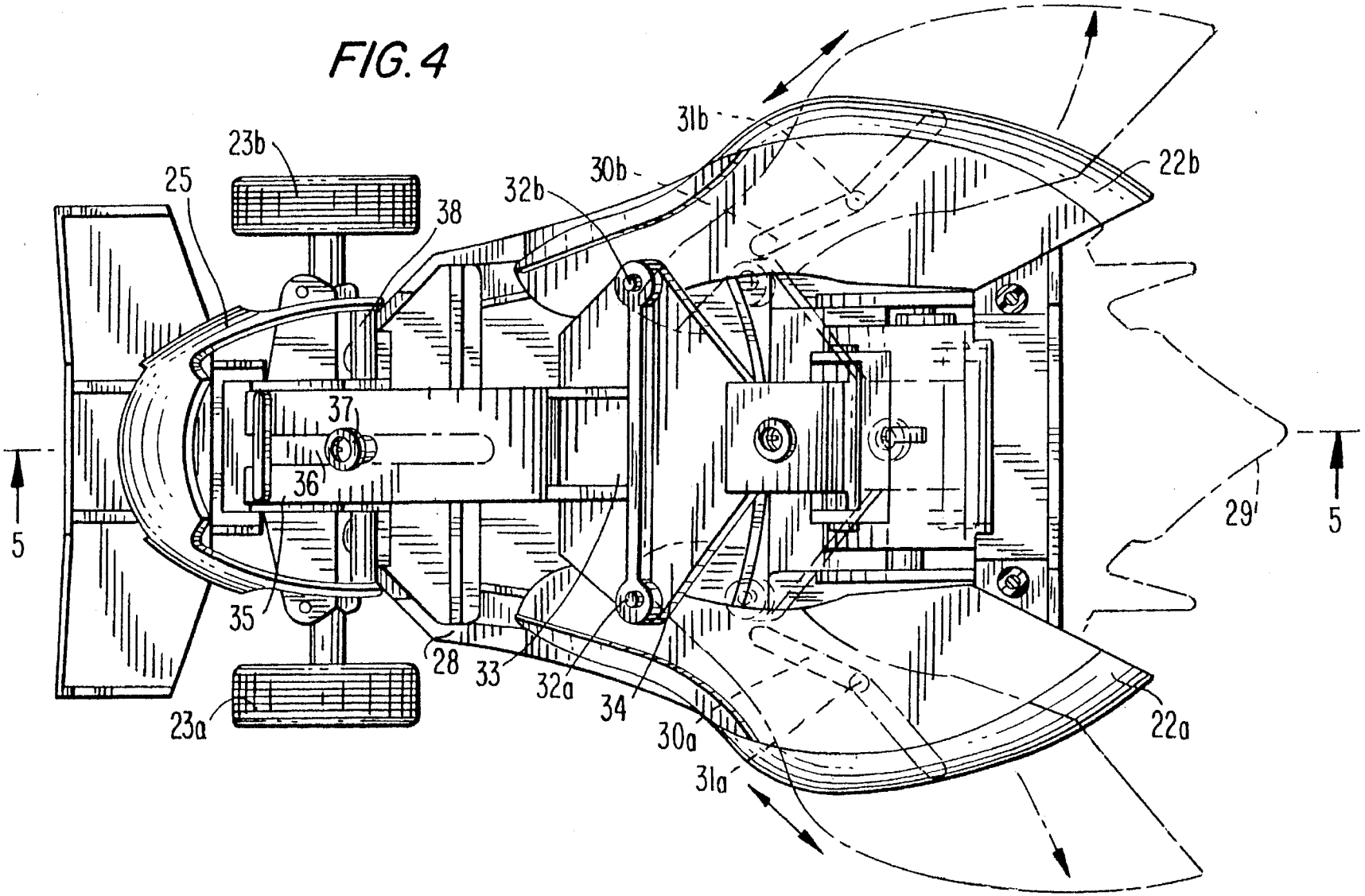
FIG. 4 is a top plan view of the toy vehicle depicted in FIG. 3, but with an upper body component removed.

Turning now to FIG. 4 of the drawing, it can be observed there that the aforementioned upper body portion 29 has been omitted therefrom (except for a dash-dotted indication of its position) in order to make certain features of the present invention visible. It is indicated there that the wings 22*a* and 22*b* are provided at least on their undersides with respective channels 30*a* and 30*b*. Each of the channels 30*a* and 30*b* receives a respective pin-shaped projection or pin 31*a* or 31*b* that is stationary with respect to, and extends upwardly from, the chassis 29.

It will be appreciated that, as the respective wing 22*a* or 22*b* moves from its retracted position shown in solid lines to its extended position indicated in dash-dotted lines in FIG. 4, the channel 30*a* or 30*b* "rides" on the associated pin 31*a* or 31*b*, so that it is at one end thereof in one of such positions, and at its other end in the other of these positions. Thus, besides serving as a guide, the respective channel 30*a* or 30*b* also delimits the extent of movement of the respective wing 22*a* or 22*b*.

The wings 22*a* and 22*b* are confined between the chassis 28 and the upper body portion 29 when the latter is mounted on the chassis 28. This confinement, coupled with the guidance provided by the cooperation of the channels 30*a* and 30*b* with their associated pins 31*a* and 31*b*, defines the areas in which the wings 22*a* and 22*b* are able to move relative to the vehicle body 21. The exact path of movement of the respective wing 22*a* or 22*b* is not determined yet, though, because the respective wing 22*a* or 22*b* has an extra degree of freedom of movement.

To remove this excess degree of freedom of movement, and to cause the respective wing 22*a* or 22*b* to conduct the desired movement, the latter is articulated, by means of a connecting pin 32*a* or 32*b*, to a slider 33. The slider 33 is accommodated in the interior of the vehicle body 21, that is between the lower and upper body parts 28 and 29, for translatory movement in the forward and rearward direction of the toy vehicle 20. The slider 33 is shown to include a generally polygonal (as shown, pentagonal) region 34 that carries the connecting pins 32*a* and 32*b*, and a generally rectangular extension 35 that extends forward from the region 34.

The extension 35 is shown to be provided at its front end portion with a slot 36. A motion-transmitting element 37, which has the configuration or construction of an enlarged-head pin, extends through the slot 36 and is connected for joint movement to an axle 38. The axle 38, in ram, is mounted on the chassis 28 for turning about its axis, and is rigidly connected, at each of its two ends, with the aforementioned upper jaw 25. This means that, when the element 37 becomes nested at one or the other of the ends of the slot 36 during the forward or rearward movement of the slider 33, it is entrained for joint movement with the slider 33 and thus causes the axle 38, to turn in the appropriate sense, and with it the upper jaw 25. It will be appreciated that the rearmost position of the slider 33 corresponds to the fully raised position of the upper jaw 25 and also to the fully extended positions of the wings 22*a* and 22*b*, whereas the wings 22*a* and 22*b* are retracted, and the upper jaw 25 is lowered to the utmost extent when the slider 33 assumes its frontmost position.

Figure 5:
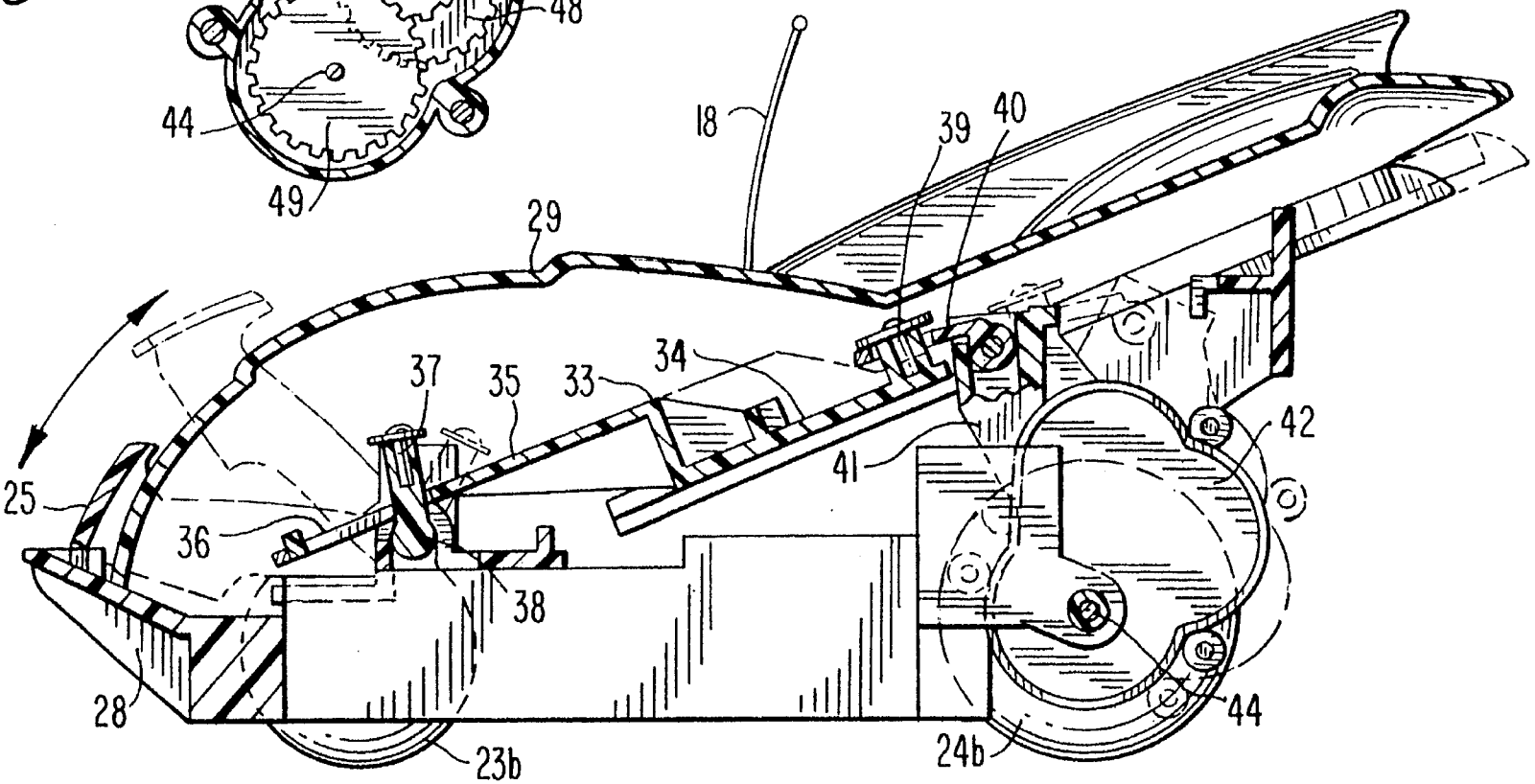
FIG. 5 is a cross-sectional view of the toy vehicle of FIG. 3, taken on line 5—5 of FIG. 4, and with a motor/gear-box assembly shown in a side elevational view.

As a comparison of FIGS. 4 and 5 of the drawing with one another will reveal, the region 34 of the slider 33 carries at its back zone another enlarged-headpin-shaped connecting element 39. As shown, the enlarged heads of the elements 37 and 39 are constituted by respective washers that are connected to the remainders of the elements 37 and 39 by associated screws. This arrangement provides sufficient leeway to accommodate at least most of the differences between the generally translatory movement of the slider 33, the angular movement of the element 37, as well as another movement of a complex nature, that is that of a connecting flap 40. More particularly, the connecting flap 40 is mounted on an extension 41 of a housing 42 of the aforementioned driving train for pivoting relative thereto about an axis extending transversely of the vehicle 20, and has another slot 43 that receives the pin-shaped connecting element 39.

If the housing 42 were stationary with respect to the body 21, then the character of movement of the flap 40 in space would be rather simple: mere pivoting relative to the housing 42. However, for reasons that will be fully explained presently, the housing 42 is mounted on the chassis 28 for angular displacement, within a severely restricted and yet not insignificant range, about a shaft 44 which is the driving shaft on which the rear wheels 24*a* and 24*b* are mounted for joint rotation therewith. This angular displacement is then superimposed on the pivoting movement of the flap 40, and this is what makes the movement of the flap 40 complex. Here again, the provision of the slot 43 for the connecting element 39, together with the pivotable mounting of the flap 40 and the room provided under the enlarged head (washer) of the element 39, provides the leeway required for the various parts to move freely, without jamming, under all circumstances.

Figure 6:
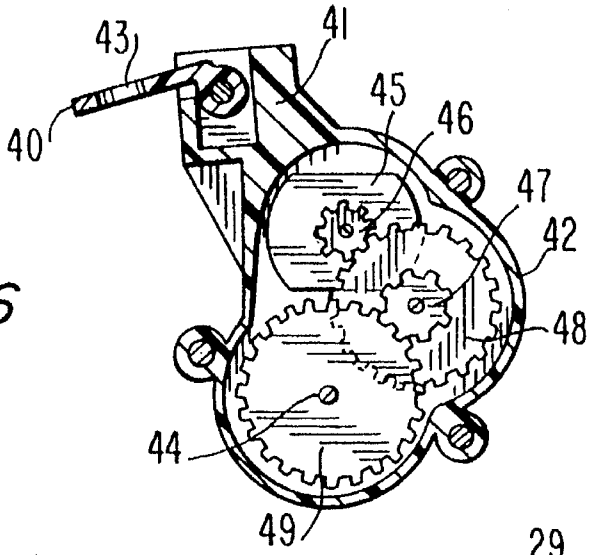
FIG. 6 is cross-sectional view, also taken on line 5—5 of FIG. 4, but showing only the motor/gear-box assembly.

Further details of the driving train that has been referred to before can be ascertained from FIG. 6 of the drawing. It may be seen there that the housing 42 receives within its confines the aforementioned driving train including a miniature electric motor 45 of any known construction. As is customary, the stator of the electric motor 45 is connected with the housing 42 while the rotor rotates an output shaft that has a first gear wheel or pinion 46 mounted thereon for joint rotation. The pinion 46 meshes with a second gear wheel 48 that, in turn, drives a third gear wheel or pinion 47 in rotation. Finally, the pinion 47 meshes with a fourth gear wheel 49 that causes the shaft 44, and thus the rear wheels 24*a* and 24*b* mounted thereon, to rotate and thus to propel the toy vehicle 20 either in the forward direction, or in the backward direction, depending on the sense in which the rotor of the reversible motor 45 is caused to rotate.

It has already been mentioned that the housing 42, rather than being rigidly mounted on the chassis 28, is merely supported on the shaft 44 for limited tilting about the axis of the shaft 44. This, in conjunction with the fact that the various components of the toy vehicle 20 that are functionally connected with the stator of the motor 45 have a total mass and, hence, inertia that greatly exceed those of the components functionally connected with the rotor of the motor 45, and the well known fact that application of a certain torque to the motor rotor is accompanied by the imposition of an equal but opposite torque to the motor stator when the motor 45 is energized, results in tilting of the housing 42 about the shaft 44 shortly, usually just a fraction of a second, before the commencement of movement of the toy vehicle 20 in the desired direction. This, of course, presupposes that the previous motor energization was in the opposite sense, or that the housing 42 got into the wrong position as far as the toy vehicle movement that is to occur is concerned in some other way, such as due to manipulation with the vehicle 20 and/or the housing 42.

This tilting, in turn, causes the slider 33 to conduct its translatory movement, and that movement causes the wings 22*a* and 22*b* to spread and the upper jaw 25 to move upwardly to bare the teeth 26 and 27 when the vehicle movement to follow is in the forward direction, and opposite movements when the ensuing vehicle movement is to be in the backward direction. It ought to be realized that the gear wheels 46 and 48, as well as the gear wheels 47 and 49, remain in the same type of meshing relationship during the tilting of the housing 42 as if the latter was immovable relative to the rest of the toy vehicle 20. This is so because the shafts on which these gear wheels 46 to 49 are mounted are supported on the housing for joint angular displacement therewith about the axis of the shaft 44.

It will be understood that each of the elements described above, or two or more together, may also find a useful application in other types of constructions differing from the type described above.

While the present invention has been described and illustrated herein as embodied in a specific construction of a toy vehicle having the appearance of a stylized bat, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A shape-changeable toy vehicle, comprising:

a) a vehicle body having front wheels, rear wheels and movable parts mounted on the body for movement between first and second positions in which the toy vehicle has different appearances; and b) means for driving the toy vehicle in one direction to move at least one of the movable parts to said first position, and for selectively driving the toy vehicle in another direction to move said at least one movable part to said second position, said driving means including an energizeable, reversible electric motor mounted on said vehicle body in operative connection with said wheels and operative, when energized in opposite senses, for respectively driving the toy vehicle in said directions, and said driving means further including a gear transmission interposed between said motor and said rear wheels, a housing accommodating said driving means and mounted on said vehicle body for tilting movement about a rear axis about which said rear wheels rotate, and means for translating said tilting movement of said housing that occurs in automatic response to energization of said motor in the appropriate sense into said movement of said at least one movable part.

2. The toy vehicle as defined in claim 1, wherein said movable parts include a pair of wings mounted on said vehicle body for movement between their extended, spread apart position and their retracted positions.

3. The toy vehicle as defined in claim 1, wherein said movable parts include an upper jaw mounted on a front region of said vehicle body for pivoting between a raised and a lowered position.

4. The toy vehicle as defined in claim 3, wherein said front region of said vehicle body has a set of upwardly directed teeth, and wherein said upper jaw has a set of downwardly directed teeth, and wherein said teeth are concealed when said upper jaw is in the lowered position and are visible when said upper jaw is in the raised position.

5. A shape-changeable toy vehicle, comprising:

a) a vehicle body;

b) front and rear wheels mounted for rotation on said vehicle body;

c) a pair of wings mounted on said vehicle body for movement between their extended, spread apart positions and their retracted positions;

d) means for driving the toy vehicle, including an energizeable, reversible electric motor in operative relation with said wheels;

e) a housing accommodating said driving means and mounted on said vehicle body for tilting movement about an axis about which said rear wheels rotate; and f) means for translating said tilting movement of said housing that occurs in automatic response to energization of said motor in the appropriate sense into said movement of said wings.

6. The toy vehicle as defined in claim 5, wherein said translating means is operative for spreading said wings preliminarily to movement of the toy vehicle in the forward direction, and vice versa prior to rearward movement of the toy vehicle.

7. The toy vehicle as defined in claim 5, wherein said translating means includes a slider accommodated within said vehicle body for translatory movement relative thereto in the frontward and rearward directions, and means for connecting said slider with said tiltable housing with sufficient leeway to avoid jamming of said translating means.

8. The toy vehicle as defined in claim 5, and an upper jaw mounted on a front region of said vehicle body for pivoting between a raised and a lowered position, and wherein said translating means is operative for raising said upper jaw preliminarily to movement of the toy vehicle in the forward direction, and vice versa prior to rearward movement of the toy vehicle.

9. A shape-changeable toy vehicle, comprising:

a) a vehicle body having a front region and a rear region;

b) front and rear wheels mounted on said front and rear regions of said vehicle body, respectively, for rotation about respective axes;

c) a pair of wings mounted on said vehicle body for movement between their extended, spread apart positions and their retracted positions;

d) an upper jaw mounted on said front region of said vehicle body for pivoting between a raised and a lowered position;

e) means for driving the toy vehicle, including an energizeable, reversible electric motor, and a gear transmission interposed between said motor and said rear wheels;

f) a housing accommodating said driving means and mounted on said vehicle body for tilting movement about said axis of said rear wheels; and g) means for translating said tilting movement of said housing that occurs in automatic response to energization of said motor in the appropriate sense into said movement of said wings and said pivoting of said upper jaw.

10. The toy vehicle as defined in claim 9, wherein said translating means is operative for raising said upper jaw and spreading said wings preliminarily to movement of the toy vehicle in the forward direction, and vice versa prior to rearward movement of the toy vehicle.

11. The toy vehicle as defined in claim 9, wherein said translating means includes a slider accommodated within said vehicle body for translatory movement relative thereto in the frontward and rearward directions, and means for connecting said slider with said tiltable housing and with said pivotable upper jaw with sufficient leeway to avoid jamming of said translating means.

12. The toy vehicle as defined in claim 11, wherein said wings are formed with guide channels for receiving guide pins fixed to said vehicle body.

* * * * *